US006666646B1

(12) United States Patent
Van Ierland et al.

(10) Patent No.: US 6,666,646 B1
(45) Date of Patent: Dec. 23, 2003

(54) DRAG REDUCTION FOR GAS TURBINE ENGINE COMPONENTS

(75) Inventors: Adrianus Van Ierland, Tilburg (NL); Adriaan Verbeek, Eindhoven (NL); Ingrid Danielse, Rotterdam (NL); Jolanda Beeren, Eindhoven (NL); Oleg Alexandrov, Tilburg (NL)

(73) Assignee: Chromalloy Holland B.V. (NL)

( * ) Notice: Subject to any disclaimer, the term of this patent is extended or adjusted under 35 U.S.C. 154(b) by 0 days.

(21) Appl. No.: 10/048,383

(22) PCT Filed: Jul. 31, 2000

(86) PCT No.: PCT/NL00/00549

§ 371 (c)(1),
(2), (4) Date: May 9, 2002

(87) PCT Pub. No.: WO01/09405

PCT Pub. Date: Feb. 8, 2001

(30) Foreign Application Priority Data

Jul. 30, 1999 (NL) ..... 1012753
Apr. 12, 2000 (NL) ..... 1014924

(51) Int. Cl.[7] ..... F01D 25/08
(52) U.S. Cl. ..... 415/177
(58) Field of Search ..... 415/177; 244/200, 244/130

(56) References Cited

U.S. PATENT DOCUMENTS 4,907,765 A * 3/1990 Hirschel et al. ..... 244/200
5,971,326 A * 10/1999 Bechert ..... 244/200
6,001,426 A * 12/1999 Witherspoon et al. ..... 427/449

FOREIGN PATENT DOCUMENTS

| | | |
|---|---|---|
| DE | 3609541 | 9/1987 |
| JP | 58067999 | 4/1983 |
| WO | 8911343 | 11/1989 |

* cited by examiner

*Primary Examiner*—Edward K. Look
*Assistant Examiner*—Kimya N McCoy
(74) *Attorney, Agent, or Firm*—Mitchell D. Bittman

(57) ABSTRACT

Gas turbine engine components which are supplied with longitudinal ribs on the areas that are in contact with a gas flow, whereby the riblets have a length of at least 5 mm, a height of at least 0.02 mm and a width of at least 0.01 mm. Those riblets are applied using the High Velocity Oxyfuel Process (HVOF). Using this technique material in the form of a powder is applied at high velocity onto the substrate of the gas turbine engine components with the riblets created preferably by positioning a mask in front of the subject part. If necessary, prior to the application of the HVOF coating, a bondcoat can be applied on the subject parts.

26 Claims, 1 Drawing Sheet

DRAG REDUCTION FOR GAS TURBINE ENGINE COMPONENTS

Figure 1:
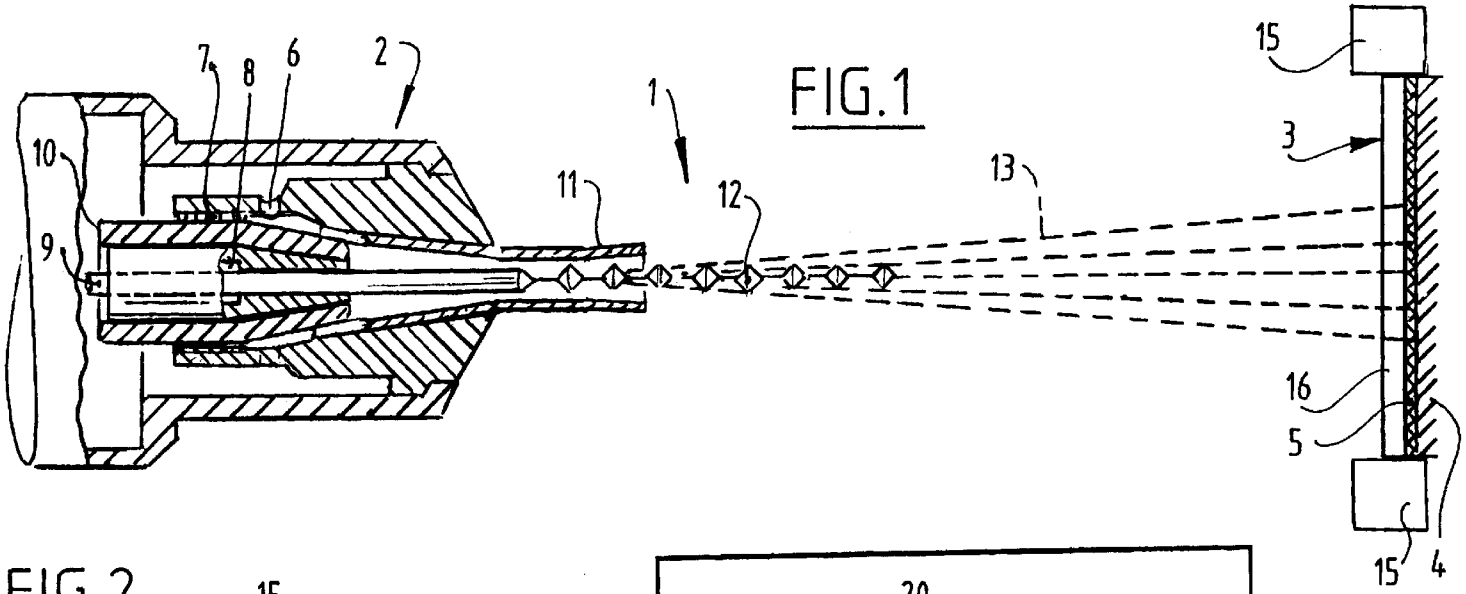

The invention relates to a gas turbine (both air and land based) component consisting of a blade or other engine component in a gas flow. The goal is to establish an efficient interaction between the gas flow and the subject engine component. In gas turbines, the purpose of the gas flow is either to provide speed to or to rotate the subject engine components, or for the engine component to accelerate the gas flow or to give the gas flow a change in direction. Suitable components include blades, vanes, stators and rotors. The interaction between the gas flow and the subject engine component is of major importance, and at the same time the gas flow should be optimized. These engine components typically comprise a Ni, Co, Ti, Al or Fe-based alloy.

One of the devices that are being used for controlling of aerodynamic drag is riblets. For application of riblets in industries other than the turbine industry, these devices are used in the form of plastic or polymers. As an example, 3M aerospace commercially manufactures a product that mainly consists of polymers. A polyethylene cover or which silicon-material is applied on the inside, and on which using a adhesive (based on acrylate) a thermoplastic polyurethane is applied. On top is this layer, a rib-like fluorpolymer layer is applied. It shall be understood that although the material as is described above theoretically could be used on gas turbine engine components, practically it will not be possible to use plastic because of the high temperatures during engine operation.

The present invention is defined in the annexed independent claims 1,11 and 23, thereof.

The objective of this invention is to reduce the drag of gas flow on such engine components.

For the engine components as described above, this objective can be realized by application of different kind of patterns on the gas flow surface of engine components, for example longitudinal riblets with a length of at least 5 mm and a height of at least 0.02 mm and a width of at least 0.01 mm. The riblets are a series of elongated projections on the surface, the projections being arranged side by side and extending lengthwise substantially in the direction of fluid flow relative to said surface for modification of a boundary layer of fluid flow on said surface. The number, height, length and width of the riblets are selected to reduce drag of the gas flow on the gas flow surface of the component.

It shall be understood that the length of the riblets for an array of riblets can have a constant value, but it is also possible that an array of riblets have a varying length, with the minimum length of 5 mm for individual riblets. Preferably at least 10 columns of riblets are applied to the component surface.

This invention describes a method known as High Velocity Oxyfuel method (HVOF) to apply a metallic and/or ceramic material as riblets on a substrate surface. Surprisingly it appears that if such a metallic/ceramic powder material is applied at high velocity and elevated temperatures it is still effective for the use on engine components to reduce the drag. Using this technique it is possible to optimize the surface of the engine components, even though the engine components are exposed to elevated temperatures, typically temperatures of greater than 500° C., for example 1000° C. and above.

Using the HVOF technique powder is applied at high velocities on the substrate via a nozzle. Ceramic and/or metallic powder is injected in the system as well as fuel.

Generally to this fuel oxygen is added. The fuel can contain Kerosine (liquid), acetylene, propane, propene, propylene, MAPP-gas or hydrogen gases. At the exit of the nozzle, the flow is surrounded by an air shield. At very high temperatures combustion takes place. Large amounts of gasses, resulting from the combustion, accelerate the injected powders. Argon or nitrogen continues to accelerate the injected powders. With a velocity of 1.2–2.4 km/sec (4000–8000 feet) per second the powders collide with the substrate surface.

As is described above, various material powders that can be applied on the engine components using the above-mentioned technique. As an example of an alloy that can be applied using the HVOF method the following material can be applied: 11–12.5 wt % Cobalt; 5.0–5.5 wt % Carbon; 1.0 wt % Iron; and Tungsten base. It shall be understood that this is just an example and other alloys and ceramics can be applied using the HVOF technique, including Ni, Co, Al, W, Cr or Fe based alloys and/or carbides thereof. Advantageously the materials used for the riblets can be selected for the additional purpose of providing erosion resistance.

Using the HVOF technique, it is possible to manufacture coatings with an extremely high tensile bond strength. Experiments have revealed vales for the tensile bond strength as high as 844 kg/cm$^2$ 12000 psi. The tensile bond strength can be improved by adding a second coating layer, consisting of, for example Inconel 718. Other suitable coatings can include Cr, Ni, Co, Al, W or Fe-based alloys. This coating can be applied by any technique that is commonly known and is usually applied over the entire section of the component surface which will be provided with a riblet coating in a later stage. The riblets or other pattern can be created using the HVOF thermal spraying technique utilizing a mask positioned in between the exit of the nozzle and the component substrate surface. This mask may be a sieve consisted of an array of adjacent parallel wires. As a result of the positioning of the mask in between the nozzle and the substrate, shadow masking will create the troughs and ridges of the riblets.

The mask dimensions can be adjusted to create an optimum riblet profile. The wire dimensions can be varied between 0.04 and 0.14 mm and the distance between the wires can be varied between 0.02 and 0.04 mm. The mask consist of a heat resistant material (eg. tungsten).

Another production method to create riblets can be described as follows: the first layer of the coating is applied without the mask, which results in a layer of uniform thickness (eg. 0.04–0.05 mm). On top of this layer, the mask will be positioned as is described above to create the riblet profile.

For producing an another type of pattern than riblets such as provision, a mask in the form of metallic plate is used with openings corresponding to the pattern being deposited. The thickness of the mask should be preferably between 0.02 and 0.03 mm, depending on the necessary height of pattern.

In a further method to create riblets a layer is created by the application of a coating by the HVOF technique, followed by machining/grinding a profile of riblets into the coating (eg. by electro discharge machining electrochemical grinding or conventional grinding).

The inventions will be described in detail below, referring to drawings giving an illustration of the production method.

FIG. 1 gives a schematic view of the HVOF process and illustrates the application of a coating on an engine component.

Figure 2:
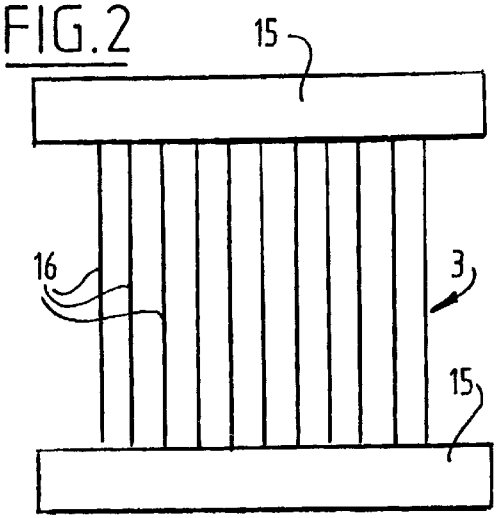

FIG. 2 gives a schematic view of the mask that is used to create the riblet profile.

Figure 3:
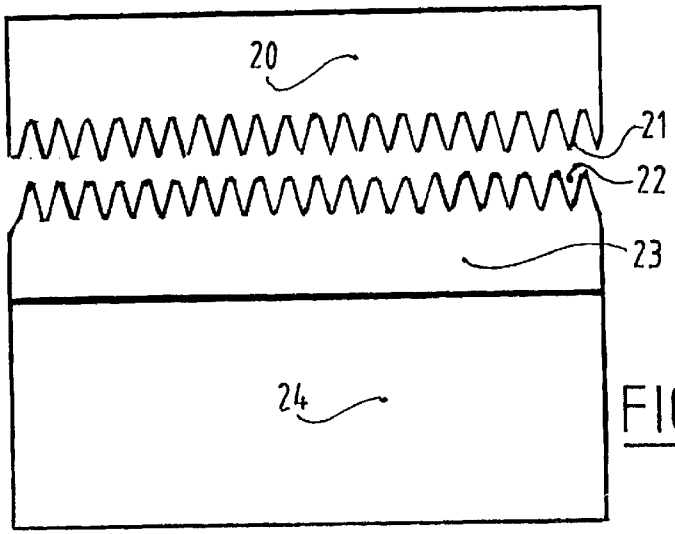

FIG. 3 gives a schematic view of an EDM electrode having a surface corresponding to the riblet profile.

In FIG. 1, the assembly is shown (1) consisting of a nozzle (2), which sprays metallic and/or ceramic powders in the molten/atomized condition at a very high velocity at the surface. The mask (3) is positioned in between the nozzle and the substrate surface. The intention of the invention is to apply riblets or other pattern such as provisions to reduce to drag onto the surface of an engine component (4). Prior to the application of the riblets, a bondcoat (5) will be applied on the component surface (4). This bondcoat (5) can consist of material that originates from nozzle (2), but can also consist of any other material applied by any other commonly known method to apply coatings. As an example, Inconel 718 material can be applied as bondcoat.

The nozzle is provided with several feeders for gas as well as for powders. The powder is injected into the nozzle via feeder (9). A carrier gas (argon or nitrogen) accelerates the powder particles (8). Prior to entrance into the nozzle, oxygen is added to the fuel (7). A ceramic cover (10) protects the nozzle against the high temperatures and pressure and prevents the nozzle from wear. The external part of the nozzle (2) is protected against the conditions inside of the nozzle by means of compressed air (6). This compressed air also acts as a shield over the exiting molten powder particles. The injected powder material that can exist for instance of cobalt/tungsten-carbide alloy is molten at very high temperatures (approximately 2000° C.) at the edit of the nozzle in the combusted fuel-oxygen gas mixture. The temperature at combustion can be as high as 2200–3200° C. At these elevated temperatures, shock waves are developed, shown on the figure as diamonds (12). Downstream the flow will relax slightly and atomization will be established (13). At very high velocity the particles will pass the vertical wires of the mask (3) and subsequently will collide with and adhere to the bondcoat (5).

FIG. 2 shows a detail of the mask in the form of sieve. This sieve exists of end faces (15,15), whereby heat resistant wires (16) are tightened between the end faces. The distance between the heat resistant wires and the thickness of the individual wires relates to the required pattern consisting of riblets on the substrate surface (4).

An example of a riblet profile with a length of 20 mm and a riblet height of 0.07 mm and a distance between the riblet-tops of 0.05 mm applied using the technique as described above, can be given.

In the example, the subject engine component is a high pressure compressor rotor blade.

In an alternate embodiment the riblets are machined into the HVOF coating by electro discharge machining. The EDM electrode will have a working surface corresponding to the surface of the engine component into which the riblets will be applied. As shown in FIG. 3 the EDM electrode 20 has a working surface 21 which corresponds to the riblet profile 22 of the HVOF coating 23 on the engine component 24.

It should be understood that the invention as given above is described based on a preferred situation. Numerous adjustments on the process are possible without getting outside the range of this invention as is described in detail in attached claims.

What is claimed is:

1. A gas turbine engine component in the gas flow comprising a plurality of riblets deposited onto the gas flow surface of the engine component effective to reduce drag, said riblets having a length of at least 5 mm, a height of at least 0.02 mm, and a width of at least 0.01 mm, wherein, the riblets are deposited on the gas flow surface by a high velocity oxyfuel process.

2. Component of claim 1 wherein the riblets have a length of form about 5 mm to 200 mm, a height 0.02 mm to 0.5 mm and a width of from 0.01 mm to 0.03 mm.

3. Component of claim 1 wherein the gas flow surface has at least 10 columns of riblets, extending in the direction of the gas flow.

4. Component of claim 3 wherein the component is comprised of a Ni, Co, Ti, Al or Fe-based alloy.

5. Component of claim 4 further comprising a coating on the engine component surface with the riblets applied to the coating.

6. Component of claim 5 wherein the riblets comprise a ceramic and/or metallic material.

7. Component of claim 6 wherein the riblet material is chosen from the group consisting of a Cr, W, Ni, Co, Al and Fe-based alloy and carbides thereof.

8. Component of claim 5 wherein the coating is selected from the group consisting of a Cr, Ni, Co, Al, W, and Fe-based alloy and carbides thereof.

9. Component of claim 1 wherein the number, height, length and width of riblets are effective to reduce drag of the gas flow on the gas flow surface of the component.

10. Component of claim 9, wherein the engine component is selected from the group consisting of blade, vane, stator and rotor.

11. Process for applying a plurality of riblets onto the gas flow surface of a gas turbine engine component comprising:

depositing riblets onto the gas flow surface by a high velocity oxyfuel process wherein the riblets are effective to reduce drag and have a length of at least 5 mm, a height of at least 0.02 mm and a width of at least a 0.01 mm.

12. Process of claim 11 wherein the riblets are deposited by use of a mask positioned between the gas flow surface and a nozzle used to inject molten particles in the high velocity oxyfuel process.

13. Process of claim 12 wherein the mask consists of heat resistant wires.

14. Process of claim 13 wherein the diameter of the wires is from 0.04 to 1.4 mm and the distance between the wires is 0.02 to 0.05 mm.

15. Process of claim 14 wherein the velocity of the molten particles is from 4000 to 8000 feet per second.

16. Process of claim 15 further comprising a coating on the engine component surface with the riblets applied to the coating.

17. Process of claim 16 wherein the riblets comprise a ceramic and/or metallic material.

18. Process of claim 17 wherein the riblet material is chosen from the group consisting of a Cr, Ni, Co, Al, W and Fe-based alloy and carbides thereof.

19. Process of claim 18 wherein the engine component is selected from the group consisting of blade, vane, stator and rotor.

20. Process of claim 11 wherein the high velocity oxyfuel process deposits a coating layer followed by machining/grinding riblets into said coating layer.

21. Process of claim 20 wherein the riblets are machined by electro discharge machining.

22. Process of claim 20 wherein the riblets are machined by electro-chemical grinding.

23. A method of reducing turbulent drag on gas turbine engine components in the gas flow comprising: depositing onto a gas flow surface of the component a pattern of protrusions effective to decrease turbulent drag, said pattern being deposited by a high velocity oxyfuel process through a mask positioned between the gas flow surface and a nozzle used to inject molten particles in the high velocity oxyfuel process.

24. Method of claim 23 wherein the mask is a sieve consisting of heat resistant wires.

25. Method of claim 24 wherein the mask is a metallic plate with openings corresponding to the pattern being deposited.

26. Method of claim 25 wherein the thickness of the plate is 0.02 to 0.3 mm.

* * * * *